US007071427B2

(12) United States Patent
Houck, III et al.

(10) Patent No.: US 7,071,427 B2
(45) **Date of Patent: *Jul. 4, 2006**

(54) FUSE BLOCK WITH INTEGRAL DOOR SENSING ROTARY DISCONNECT

(75) Inventors: Theodore J. Houck, III, Milwaukee, WI (US); Jie Ning, Shorewood, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 66 days.

This patent is subject to a terminal disclaimer.

(21) Appl. No.: 10/950,887

(22) Filed: Sep. 27, 2004

(65) Prior Publication Data

US 2005/0040019 A1 Feb. 24, 2005

Related U.S. Application Data

(63) Continuation-in-part of application No. 10/714,433, filed on Nov. 14, 2003, now Pat. No. 6,881,909, which is a continuation-in-part of application No. 10/298,326, filed on Nov. 18, 2002, now Pat. No. 6,700,081.

(51) Int. Cl.
*H01H 9/22* (2006.01)

(52) U.S. Cl. ..... 200/50.05

(58) Field of Classification Search ..... 200/50.01, 200/50.02, 50.05, 50.06, 50.07, 50.09, 50.12, 200/50.13, 50.15, 330, 331
See application file for complete search history.

(56) References Cited

U.S. PATENT DOCUMENTS

| | | | | |
|---|---|---|---|---|
| 1,404,865 | A | 1/1922 | Kries | |
| 1,417,920 | A | 5/1922 | Jessen | |
| 1,812,896 | A | 7/1931 | Olley | |
| 2,053,997 | A | 9/1936 | Krcek | |
| 2,465,079 | A | 3/1949 | Fitzgerald | |
| 3,122,615 | A | 2/1964 | Chace | |
| 3,581,032 | A | 5/1971 | Christensen | |
| 4,405,844 | A * | 9/1983 | Dizon et al. | 200/50.12 |
| 5,493,084 | A | 2/1996 | Whitaker | |
| 5,609,244 | A | 3/1997 | Reiter | |
| 6,700,081 | B1 | 3/2004 | Houck, III | |
| 6,710,697 | B1 | 3/2004 | Houck, III | |
| 6,881,909 | B1 * | 4/2005 | Houck, III | 200/50.13 |

FOREIGN PATENT DOCUMENTS

| | | |
|---|---|---|
| DE | 1193144 B | 5/1965 |
| DE | 1954 849 A1 | 9/1996 |
| EP | 0564173 A1 | 6/1993 |

* cited by examiner

*Primary Examiner*—Neil Abrams
(74) *Attorney, Agent, or Firm*—Quarles & Brady, LLP; Alexander M. Gerasimow

(57) ABSTRACT

A disconnect is coupled to a rotary shaft communicating with a door-mounted knob provides an operator on the shaft for engaging the door handle to detect closure of the door. The operator includes a pair of coupling mechanisms that control the transmission of torque between the operator and the shaft depending on whether the door is open or closed. Specifically, when the door is closed, torque applied to the operator in both directions is transmitted to the shaft. If the door is open, torque applied to the operator is only transmitted in one direction to disconnect power through the disconnect unless the user performs a predetermined sequence of events to rotatably couple the operator to the shaft with respect to rotation in the opposite direction that connects power through the disconnect. When the door is open the operator may be easily used to disconnect power but may be used to connect power only when the user manipulates the operator in a certain way.

58 Claims, 11 Drawing Sheets

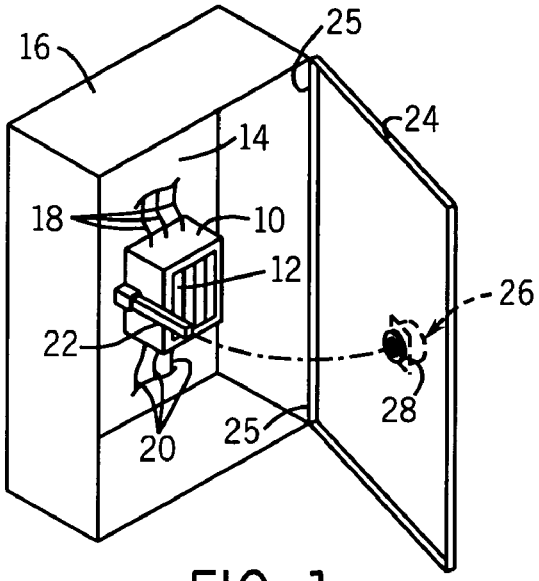
FIG. 1
PRIOR ART
FIG. 2
PRIOR ART
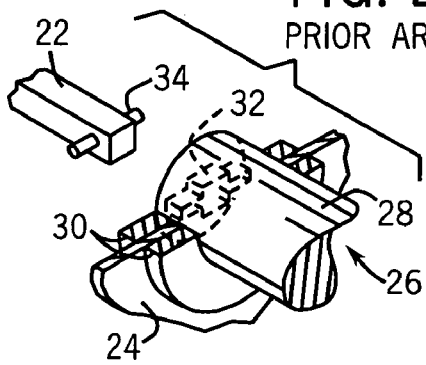

FUSE BLOCK WITH INTEGRAL DOOR SENSING ROTARY DISCONNECT

CROSS-REFERENCE TO RELATED APPLICATIONS

This application is a Continuation-In-Part of U.S. patent application Ser. No. 10/714,433 filed Nov. 14, 2003, now U.S. Pat. No. 6,881,909, which is in turn a Continuation-in-Part of U.S. patent application Ser. No. 10/298,326, filed Nov. 18, 2002, now U.S. Pat. No. 6,700,081, the disclosure of each of which is hereby incorporated by reference as if set forth in its entirety herein.

STATEMENT REGARDING FEDERALLY SPONSORED RESEARCH OR DEVELOPMENT

Not Applicable

BACKGROUND OF THE INVENTION

The present invention relates to electrical disconnects for mounting in cabinets and having a forwardly-extending, rotary shaft that may engage a handle on the cabinet door when the cabinet door is closed, and in particular to an improvement in such a disconnect that reduces the chance of current flowing through the disconnect when the cabinet door is open.

Referring to FIG. 1, a disconnect in the form of a standard fuse block 10 of the prior art may receive fuse cartridges 12 along its front face and may attach at its rear face to the rear wall 14 of a metal cabinet 16.

Input terminals along the top of fuse block 10 may receive wires 18 which connect independently to one side of each fuse cartridge 12, the latter which interconnect wires 18 to wires 20 attached to output terminals along the bottom of the fuse cartridge 12. Wires 18, for example, may be connected to a source of three-phase power and wires 20, for example, may be connected to a motor or other piece of equipment.

Fuse block 10 may be activated to electrically disconnect wires 18 from the respective fuse cartridges 12. The fuse block 10 may be controlled by a rotary shaft 22 along one side of the fuse block 10 and extending in an orientation perpendicular to the rear wall 14 of cabinet 16 toward an open face of the cabinet.

The open face of the cabinet may be covered by a door 24 attached by hinges to one side of the cabinet 16. Door 24 may support a captively mounted rotary knob 26 having an inwardly extending connector 28.

Referring now to FIG. 2, knob 26 may include connector 28 that extends inwardly through an opening in the door 24. Connector 28 includes retaining flanges 30 for retaining it rotatably within that opening.

When door 24 is closed about the cabinet 16, connector 28 of the knob 26 engages the outermost end of rotary shaft 22, thereby allowing rotary shaft 22 to be operated by knob 26 when door 24 is closed on cabinet 16. Specifically, an inwardly facing end of connector 28 may include a keyway 32 receiving a rectangular end of rotary shaft 22 and a pin 34 extending perpendicularly through the rotary operator. Turning knob 26, in turn, rotates shaft 22 to electrically disconnect or connect power to wires 20.

Referring again to FIG. 1, knob 26 allows disconnection of power to wires 20 when the door 24 on the cabinet 16 is closed. However, when door 24 is open, rotary shaft 22 is exposed, thereby enabling power to be inadvertently reconnected by counter rotation the shaft 22.

One apparatus for preventing the reconnection of power while the door is open includes bracketing that is connected to the exterior of fuse block 10. The bracketing enables knob rotation to connect and disconnect the power when the door is closed, and further prevents inadvertent counter rotation of the knob to reconnect the power when the door is open. While this apparatus is suitable for its intended purpose, the bracketing requires modification of an existing fuse block.

It would therefore be desirable to provide a less intrusive mechanism for preventing rotation of the operator in a direction that would reconnected power when the cabinet door is open.

BRIEF SUMMARY OF THE INVENTION

One aspect of the present invention provides an operator assembly for controlling a disconnect having a rotary shaft adapted to receive a portion of a door-mounted knob and rotating in a first direction to connect electrical current through the disconnect, and rotating in a second direction to prevent electrical current from flowing through the disconnect. The operator assembly includes a housing configured to receive the rotary shaft, and a unidirectional coupling mechanism that is connected between the shaft and the housing, wherein the uni-directional coupling mechanism facilitates uni-directional rotation of the shaft in response to rotation of the operator assembly.

It is thus one object of the invention to prevent power from being connected and disconnected simply by rotating the operator housing.

In another aspect, the operator assembly includes a bi-directional coupling mechanism that couples the shaft and the handle with respect to both directions of handle rotation when the door is closed.

It is thus another object of the invention to enable current to be intuitively connected through the disconnect and to prevent current from flowing through the disconnect when the door is closed by rotating the handle in the corresponding direction.

In accordance with yet another aspect of the invention, the bi-directional coupling mechanism can be engaged by the user when the door is open by performing a predetermined sequence of events.

It is thus another object to enable a skilled user to intentionally connect power to the disconnect when the door is open while reducing the likelihood that power will be inadvertently connected.

In still another aspect, the operator assembly includes a clutch that engages the bi-directional coupling mechanism when either the door is closed or the user performs the predetermined sequence of events.

It is thus another object of the invention to provide a mechanism for activating the bi-directional coupling mechanism, and operating the uni-directional coupling mechanism when the bi-directional coupling mechanism is disengaged.

In another aspect, the clutch is operated by depressing a hub relative to the handle to engage the bi-directional coupling mechanism and releasing the hub relative to the handle to disengage the bi-directional coupling mechanism and engage the secondary coupling mechanism.

It is thus another object to engage the bi-directional coupling mechanism automatically when the door is closed, to selectively engage the bi-directional coupling mechanism when the door is open, and to automatically engage the uni-directional coupling mechanism when the bi-directional coupling mechanism is disengaged.

In another aspect, the operator assembly is carried by the shaft.

It is thus another object to provide an operator assembly that can be retrofitted to a pre-existing disconnect without requiring modification of the disconnect.

These and other aspects and advantages of the present invention will appear from the following description. In the description, reference is made to the accompanying drawings which form a part thereof, and in which there is shown by way of illustration, and not limitation, preferred embodiments of the invention. Such embodiments do not necessarily represent the full scope of the invention, and reference should therefore be made to the claims herein for interpreting the scope of the invention.

BRIEF DESCRIPTION OF THE DRAWINGS

FIG. 1 is a perspective view of a prior art fuse block described above and mounted to the rear of a cabinet and having a forwardly extending rotary disconnect operator that may be received by a door-mounted handle when the cabinet door is closed;

FIG. 2 is a fragmentary view of the door-mounted handle immediately before engagement with the rotary disconnect operator as known in the prior art;

DETAILED DESCRIPTION OF THE PREFERRED EMBODIMENT

Figure 3:
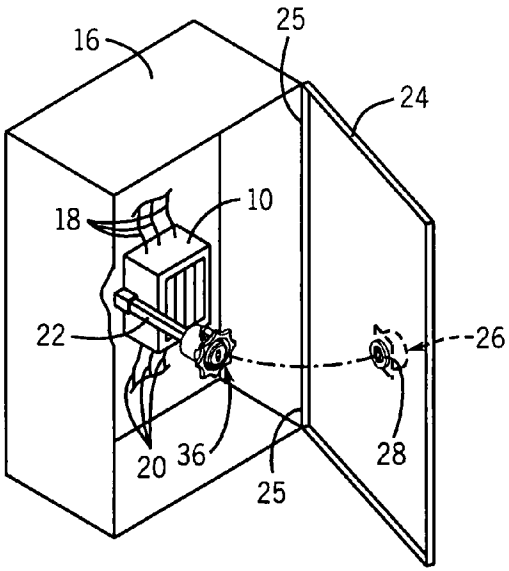
FIG. 3 is a perspective view of a fuse block mounted to the rear of a cabinet and having a forwardly extending rotary disconnect shaft extending through an operator assembly having a handle constructed in accordance with the preferred embodiment.
Figure 4:
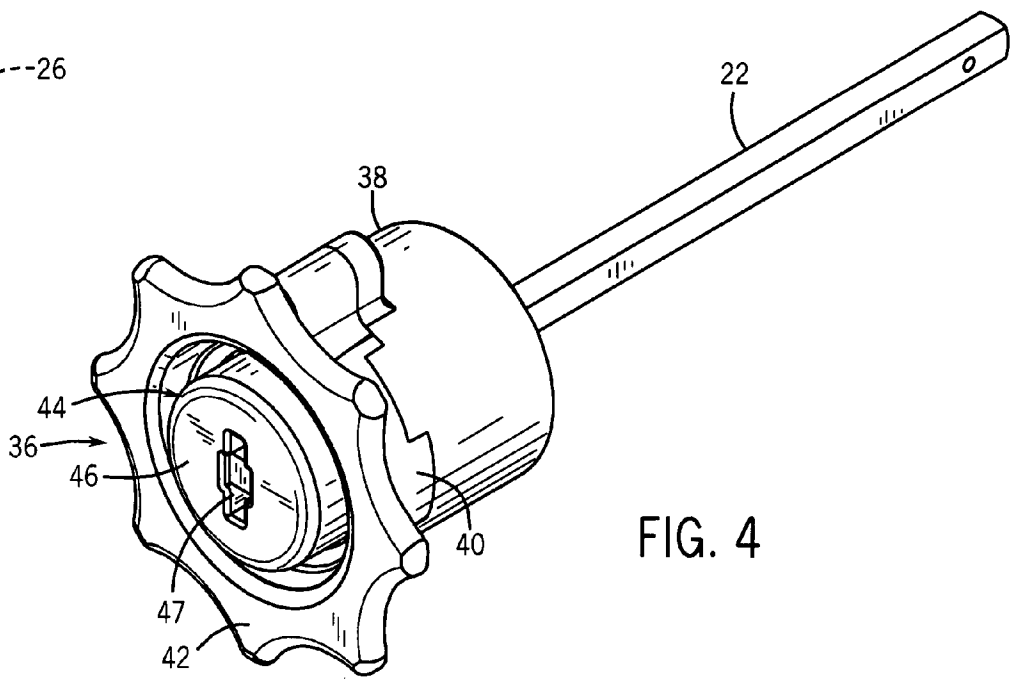
FIG. 4 is a perspective view of the operator assembly illustrated in FIG. 3 that receives the shaft.

Referring to FIGS. 3 and 4, the present invention modifies the fuse block 10 described above by mounting an operator assembly 36 to the axially outer end of a rotary shaft 22 coupled to the fuse block 10. While an exemplary embodiment of the present invention is described as controlling electrical current through fuse block, it should be appreciated that the present invention is applicable to any electrical disconnect, including fuses, circuit breakers, and traditional switches.

Operator assembly 36 extends generally axially, and interfaces with door knob 26 and, in particular, with connector 28. Operator assembly 36 is thus operable by a user to connect power to fuses on fuse block 10, and disconnect power from fuse block 10. Operator assembly 36 preferably comprises a plastic, though one skilled in the art will recognize that any material suitable to withstand the stress and strain experienced during operation falls within the scope of the present invention.

Figure 5:
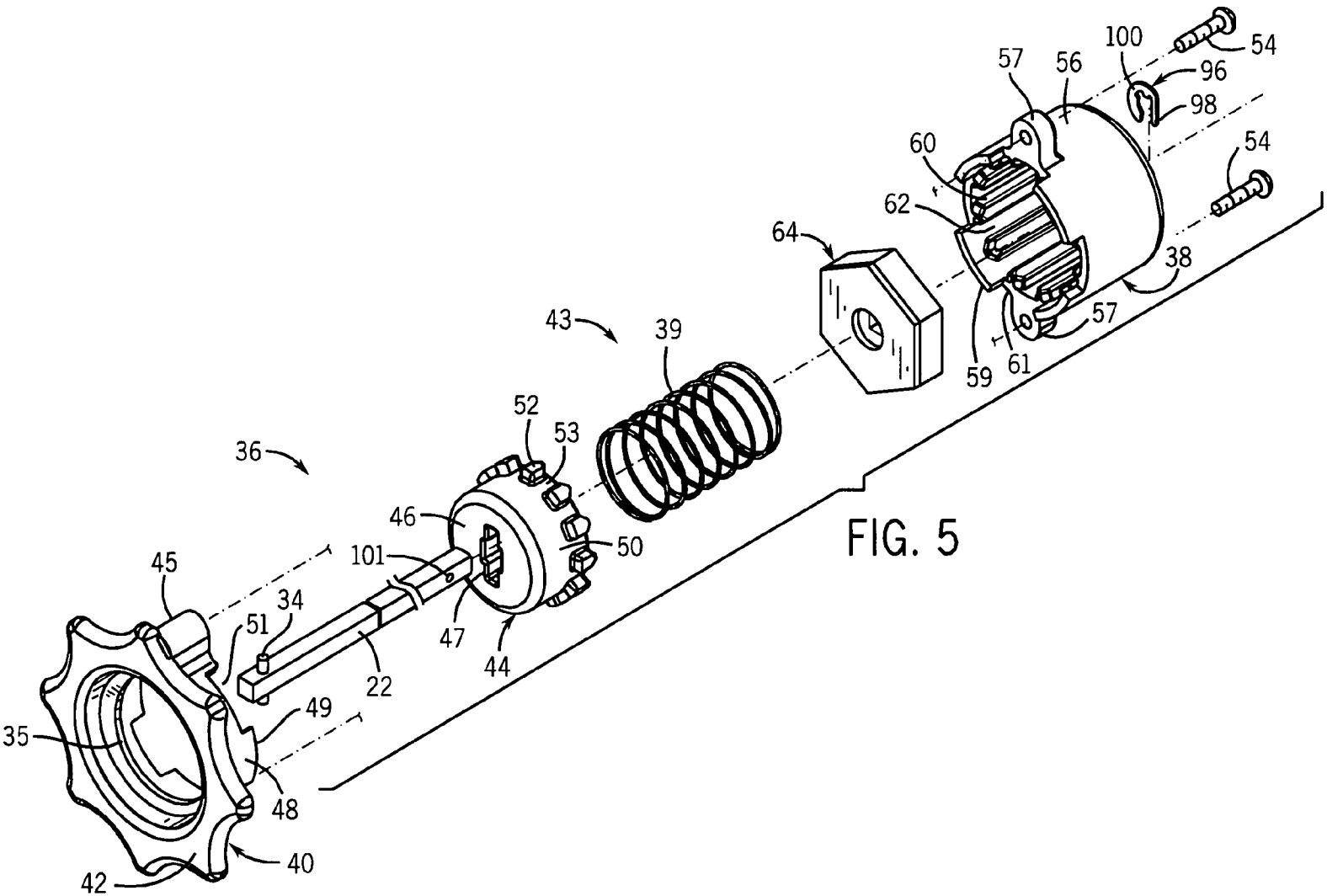
FIG. 5 is an assembly view of the operator assembly illustrated in FIG. 3

Referring now to FIG. 5 in particular, one exemplary embodiment of operator assembly 36 is formed from a housing including an inner shell 38 fastened to an outer handle that retains a uni-directional coupling mechanism 64, a clutch 43 including a spring 39, and an inner cylindrical hub 44. Operator assembly 36 is carried by the axially outer end of shaft 22.

Figure 11:
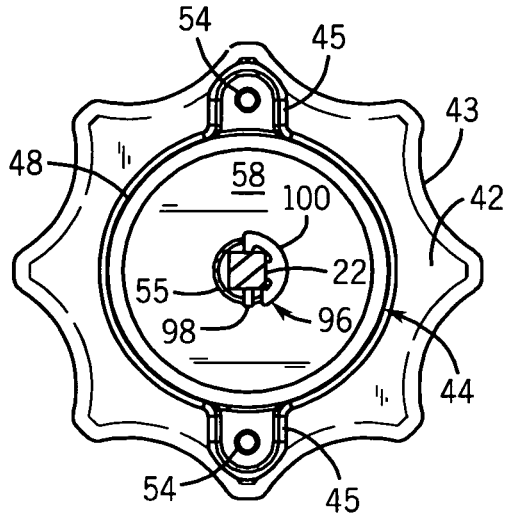
FIG. 11 is a bottom view of the operator assembly illustrated in FIG. 3.

Referring also to FIG. 11, inner shell 38 includes an annular cup 56 open at its axially outer end and closed at its axially inner end by an end face 58. A circular aperture 55 extends axially through face 58, and is centrally disposed to pass shaft 22. The diameter of aperture 55 is greater than the largest cross-sectional dimension across shaft 22 such that rotation of shell 38 does not cause face 58 to impart rotational forces onto shaft 22. A clip 96 is provided that includes a pin 98 and a fastener clamp 100. Pin 98 is inserted through an aperture 101 extending radially through shaft 22, and is retained by clamp 100 which applies radial pressure against shaft 22. Clip 96 abuts face 58 and, accordingly, the axial location of aperture 101 determines the position of operator assembly 36 with respect to shaft 22.

A plurality of beveled ribs 60 extends axially along the radially inner surface of body 56. Ribs 60 are equally spaced circumferentially about body 56 to define a plurality of interposed recesses 62. A plurality of radially spaced teeth 59 extends axially out from the outer end of body 56, and are equally spaced circumferentially about body 56 to define a corresponding plurality of interposed recesses 61. A pair of opposing mounting flanges 57 extends radially out from the axially outer end of body 56, and includes a pair of apertures sized to receive corresponding screws 54.

Referring now to FIGS. 5 and 14–16, a uni-directional coupling mechanism 64 is provided in the form of a ratchet assembly that enables uni-directional operation to disconnect power from fuse block 10. Ratchet assembly 64 includes a bearing cup 66 having a hexagonal outer wall 68 that is sized to be received by ribs 60 such that rotation of inner shell causes cup 66 to correspondingly rotate. Cup 66 further includes an internal substantially cylindrical bore 70 forming a grooved ratchet chamber. Specifically, a track 73 defined by a plurality of axially extending arc-shaped grooves 71 (and corresponding teeth 75 interposed between adjacent grooves 71) defines the outer periphery of chamber 70.

Chamber 70 is closed at its axially inner end by a base 72 having a circular opening 74 extending centrally there through that is sized to loosely and rotatably pass shaft 22. A hexagonal cover 77 is provided and affixed to the axially outer end of bearing cup 66. Cover 77 is preferably transparent, and defines a central aperture 79 that matches aperture 74. As a result, rotation of shaft 22 does not directly cause bearing cup 66 and cover 77 to rotate.

Ratchet assembly 64 further includes a bearing carrier plate 76 having a generally cylindrical outer wall 78 having a diameter slightly less than the inner diameter of chamber 70. An aperture 85 extends axially through carrier plate 76, and defines a square or other suitable cross-section configured to snugly receive shaft 22 such that rotation of shaft 22 causes carrier plate 76 to rotate therewith. Specifically, outer wall 78 rides along grooves 71 as carrier plate 76 rotates within chamber 70 during operation.

A pair of opposing elongated rectangular cutouts forms pockets 78 in carrier plate 76 offset 180° with respect to each other. Each pocket 78 is defined by first guide wall 80 and a second support wall 82 oriented perpendicular to guide wall 80. Guide wall 80 is elongated with respect to support wall 82. Each pocket 78 receives a spherical bearing member 84 supported by one end of a compression spring 86 that is grounded at its other end by support wall 82. Each spring 86 biases its corresponding bearing member 84 against grooved track 73.

When a counterclockwise torque is applied to bearing cup 66, the force causes teeth 75 to bias bearing members 84 against the corresponding non-resilient guide walls 80. The counterclockwise torque is thus transferred to carrier plate 76. Accordingly, bearing cup 66, carrier plate, and shaft 22 all rotate counterclockwise.

On the contrary, when a clockwise torque is applied to bearing cup 66 as indicated by Arrow A, bearing cup 66 is caused to rotate clockwise. As bearing cup 66 rotates, the radial forces resulting from engagement between bearing members 84 and teeth 75 cause springs 86 to compress. The compression causes bearing members 84 to slide along guide wall 80 as they cam over teeth 75 and fall into adjacent grooves 71 whose surfaces are defined by a radius that generally match the radius of bearing members 84. Bearing members 84 continue to ratchet along track 73 as carrier plate 76 continues to rotate clockwise.

Figure 17:
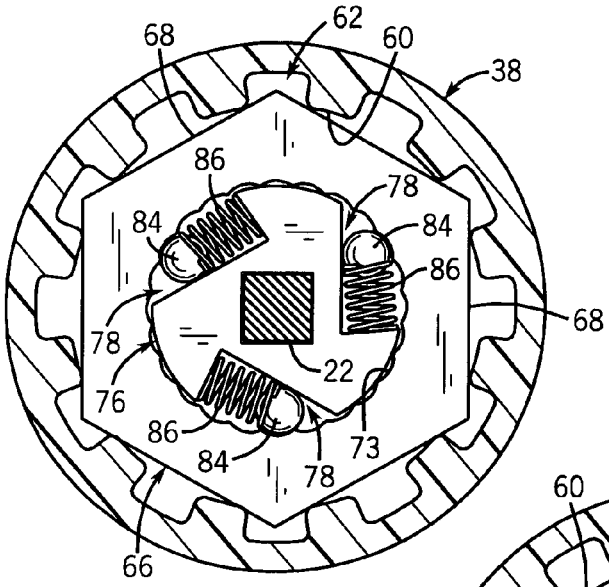
FIG. 17 is a top plan view of a uni-directional coupling mechanism constructed in accordance with an alternative embodiment.
Figure 18:
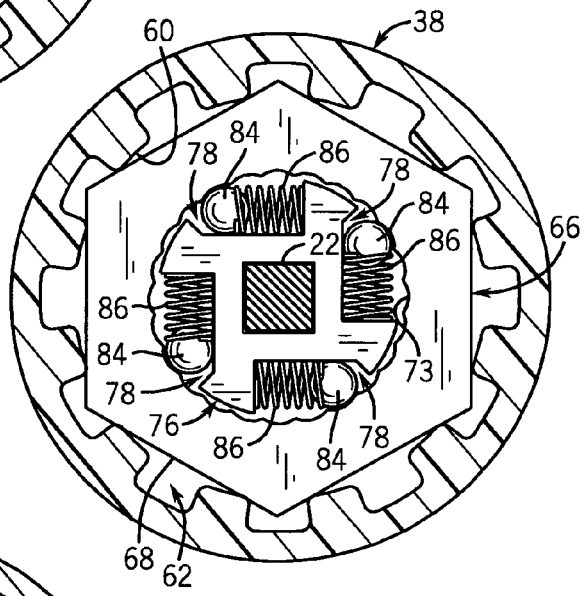
FIG. 18 is a top plan view of a uni-directional coupling mechanism constructed in accordance with another alternative embodiment.
Figure 19:
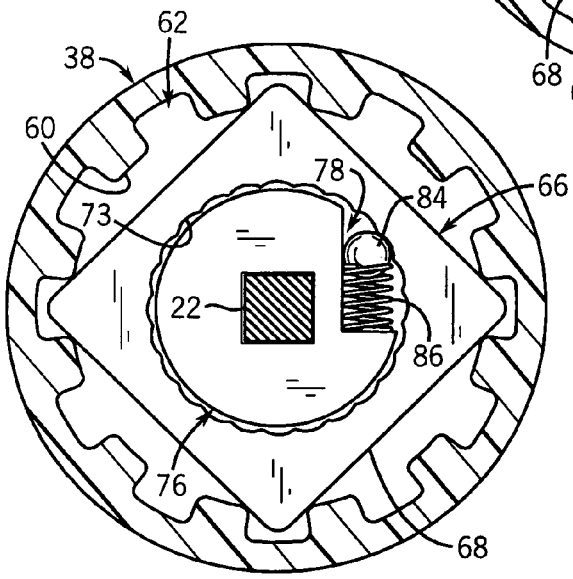
FIG. 19 is a top plan view of a uni-directional coupling mechanism constructed in accordance with still another alternative embodiment.

Referring now to FIGS. 17–19, ratchet assembly 64 is illustrated in accordance with several alternative embodiments having any number of pockets 78 formed in carrier plate 76. Specifically, as illustrated in FIG. 17, three pockets 78 can be oriented 120° with respect to each other in carrier plate 76. Because an additional pocket 78 is provided and an additional bearing member 84 engages track 73, additional torque is required to cause each bearing member 84 to slide along track 73 as bearing cup 66 is rotated counterclockwise. The required amount of driving torque can be increased still by providing four pockets 78 oriented 90° with respect to each other as illustrated in FIG. 18. Alternatively, the required amount of driving torque can be decreased by providing a single pocket 78 as illustrated in FIG. 19. FIG. 19 further illustrates bearing cup outer wall 68 as being square-shaped and sized to engage ribs 60 in accordance with one of several alternative configurations of outer wall 68 intended to fall within the scope of the present invention.

Figure 20:
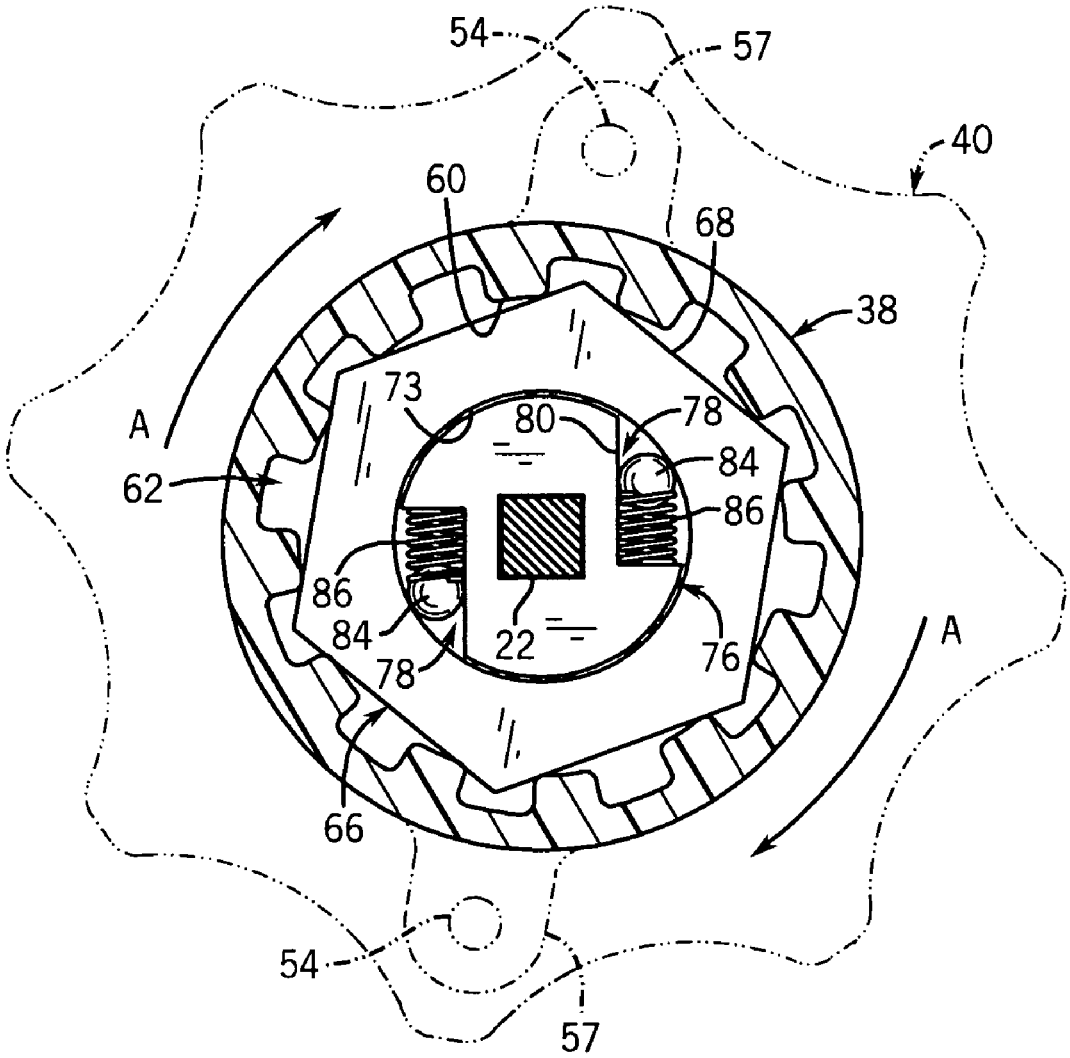
FIG. 20 is a top plan view of a uni-directional coupling mechanism constructed in accordance with yet another alternative embodiment.

Referring to FIG. 20, bearing cup 66 can be provided with a track 73 having a smooth surface as an alternative to grooves 71. Because the frictional resistance imparted onto bearing member 84 by smooth track 73 is reduced, the torque necessary to rotate bearing member 83 along track 73 is also reduced with respect to the grooved track described above. Furthermore, because a line extending tangentially to smooth track 73 at a location adjacent bearing member 84 intersects a line extending along guide wall 80, bearing member 84 will engage track 73 when a counterclockwise torque is applied to bearing cup 66, thereby rotatably coupling bearing cup 66 and carrier plate 76.

Figure 8:
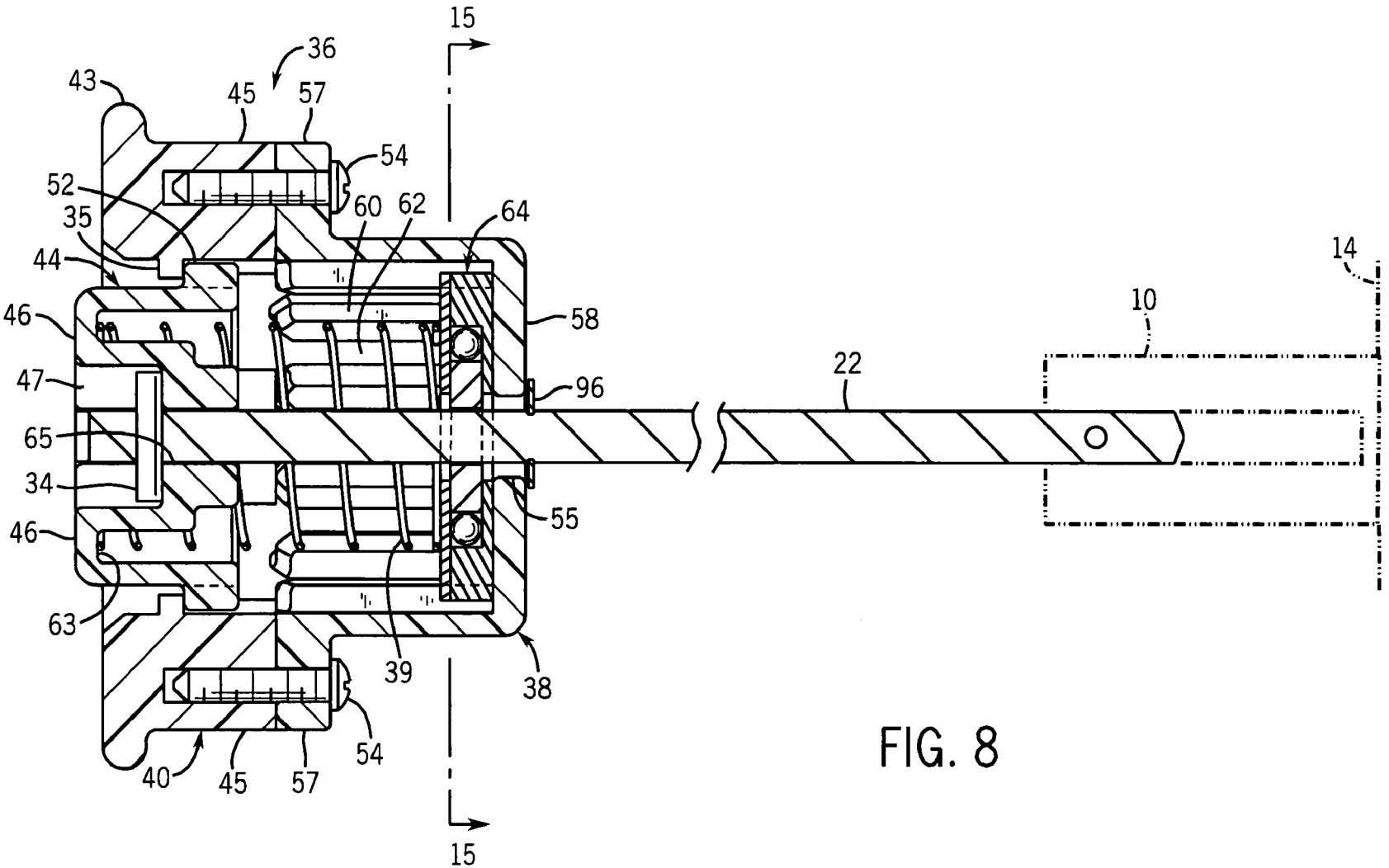
FIG. 8 is a sectional side elevation view of the operator assembly in the position illustrated in FIG. 6.

Referring now to FIGS. 5 and 8, hub 44 includes a generally cylindrical body 50 defining an internal seat that receives one end of a coil spring 39 that is seated at its opposite end against the outer axial surface of cover 77. Spring 39 is a compression spring that provides a force biasing hub 44 axially out towards handle 40.

Cylindrical body 50 is closed at one end by an axially front face 46 sized to be engaged by connector 28. Accordingly, when door 24 is closed, connector 28 depresses hub 44 against the force of spring 39.

An aperture 65 extends axially through hub 44, and defines a square cross-section configured to snugly receive shaft 22 such that rotation of hub 44 causes shaft 22 to also rotate. It should be easily appreciated, however, that shaft 22 and aperture 65 (along with the other shaft-engaging components) could assume any alternative cross-sectional shape without departing from the present invention. The axially outer end of aperture 65 defines a keyway 47 extending only partially into hub 44 sized to receive a pin 34 extending transverse from the axially outer end of shaft 22. Shaft 22 and hub 44 thus rotate in concert while keyway 47 prevents shaft 22 from being pulled through hub 44.

Figure 12:
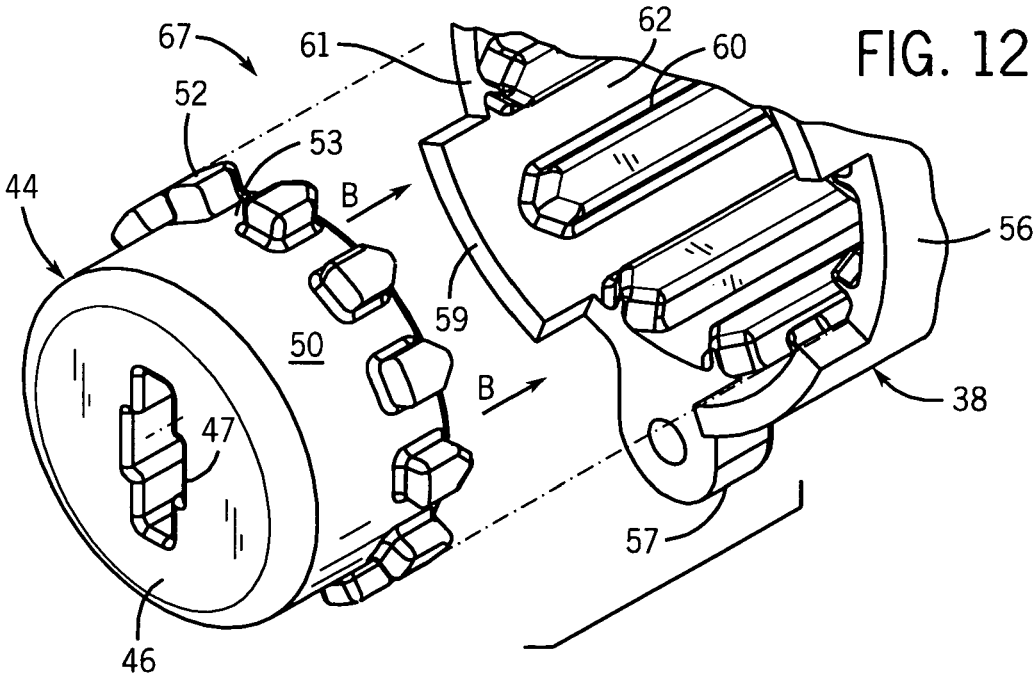
FIG. 12 is an assembly view of the operator assembly illustrating a bi-directional coupling mechanism.
Figure 13:
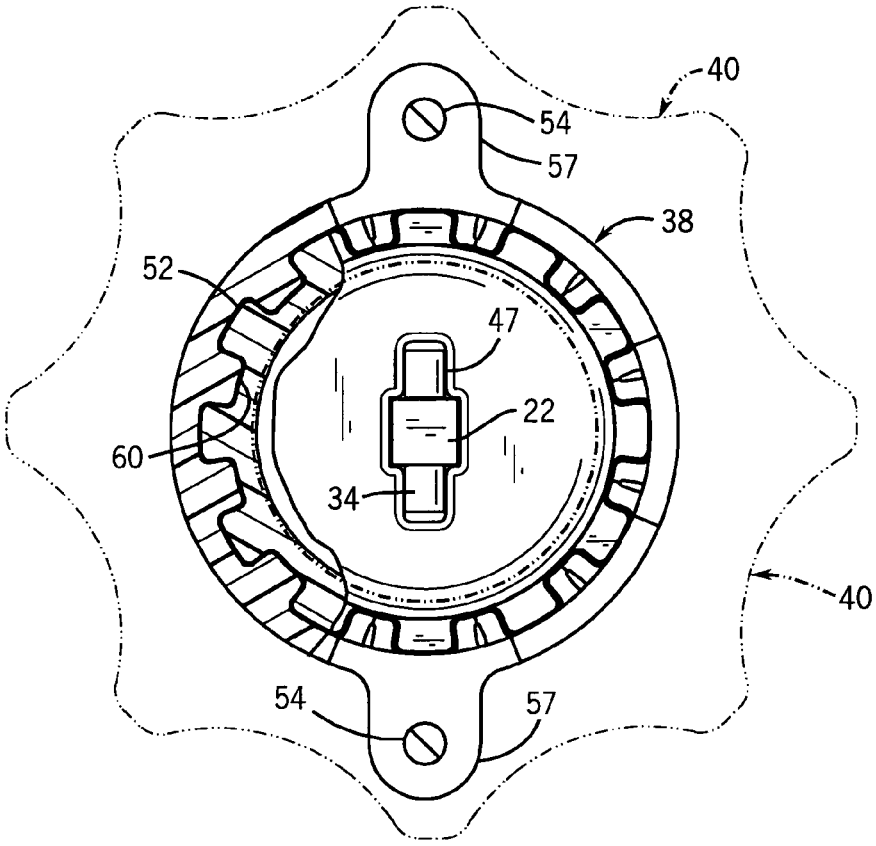
FIG. 13 is a partial sectional elevation view of the operator assembly showing the bi-directional coupling mechanism taken along line 13—13 of FIG. 9.
Figure 14:
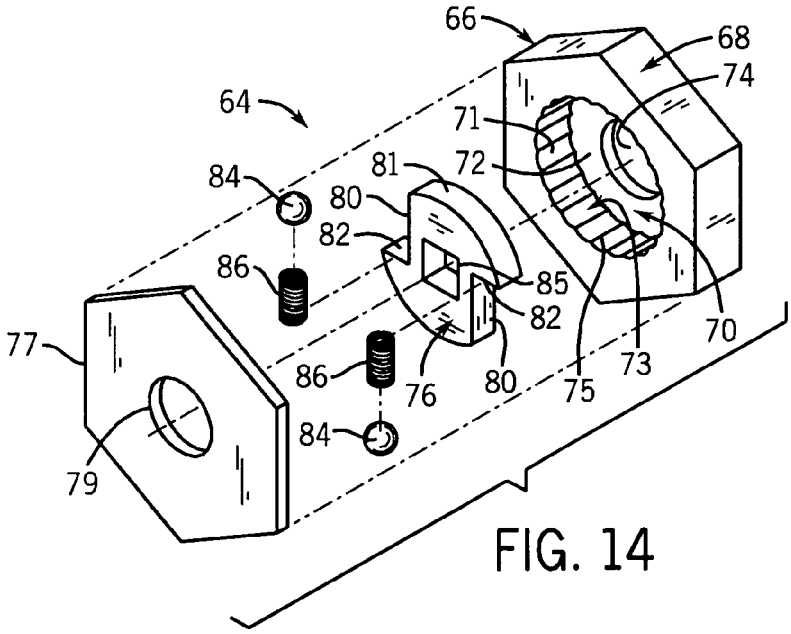
FIG. 14 is an assembly view of a uni-directional coupling mechanism.

Referring also to FIGS. 12 and 13, a bi-directional coupling mechanism 67 includes a plurality of beveled pawls 52 extending radially out from the axially inner end of body 50 and are equally spaced circumferentially about body 50 to define interposed recesses 53 that are sized to receive ribs 60. Likewise, pawls 52 are received by recesses 62. It will thus be appreciated that the diameter defined by opposing recesses 62 is slightly greater than the diameter defined by opposing pawls 52, and the diameter defined by opposing ribs 60 is slightly greater than the diameter defined by opposing recesses 53 but less than the diameter formed by opposing pawls 52. Coupling mechanism 67 is engaged and disengaged by clutch 43 as hub 44 is depressed and released, respectively, relative to shell 38, as is described in more detail below.

When bi-directional coupling mechanism 67 is engaged, pawls 52 and ribs 60 interlock hub 44 and shell 38 with respect to rotation. Accordingly, rotation of operator assembly 36, and in particular shell 38, in both the clockwise and counterclockwise directions causes hub 44 and shaft 22 to correspondingly rotate.

Referring again to FIG. 5, handle 40 is defined by an axially extending annular neck 48 that is connected at its outer end to a fluted grip 42 extending radially out from the axially outer end of handle 40. Grip is thus configured to be intuitively engaged by the hand of a user to rotate operator assembly 36 in the clockwise and counterclockwise directions, selectively causing an internal fuse block switch (not shown) to connect and disconnect, respectively, power in fuse block 10. It should be appreciated, however, that these directions of rotation can be reversed as desired to connect and disconnect the power.

A plurality of radially spaced notches 51 are formed in the axially inner end of neck 48, and are equally spaced circumferentially about neck 48, to define a corresponding plurality of locking teeth 49 interposed between adjacent notches 51. Teeth 59 and recesses 61 of shell 38 are configured to interlock with teeth 49 and recesses 51, respectively, of handle 40. A pair of threaded apertures 45 extends axially into grip 42 and face corresponding mounting flanges 57. Screws 54 thus extend through flanges 57 and into apertures 45 to secure handle 40 to shell 38.

Figure 10:
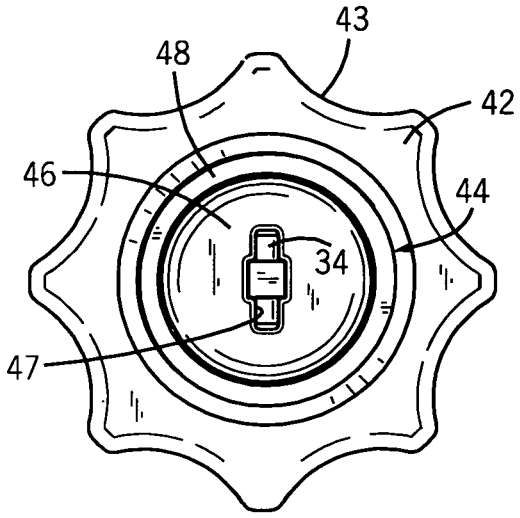
FIG. 10 is a top plan view of the operator assembly illustrated in FIG. 3.

Referring also to FIG. 10, annular neck 48 defines an inner diameter sized to receive cylindrical hub 44. An annular flange 35 extends radially in from neck 48 that is sized sufficiently large to receive cylindrical body 50 of hub 44, but is sufficiently small to abut the axially outer edges of pawls 52. Flange 35 thus provides a stop that prevents hub 44 from sliding through handle 40 during operation while enabling relative rotation between handle 40 and hub 44 (i.e., when bi-directional coupling mechanism 67 is disengaged).

System Operation

Figure 6:
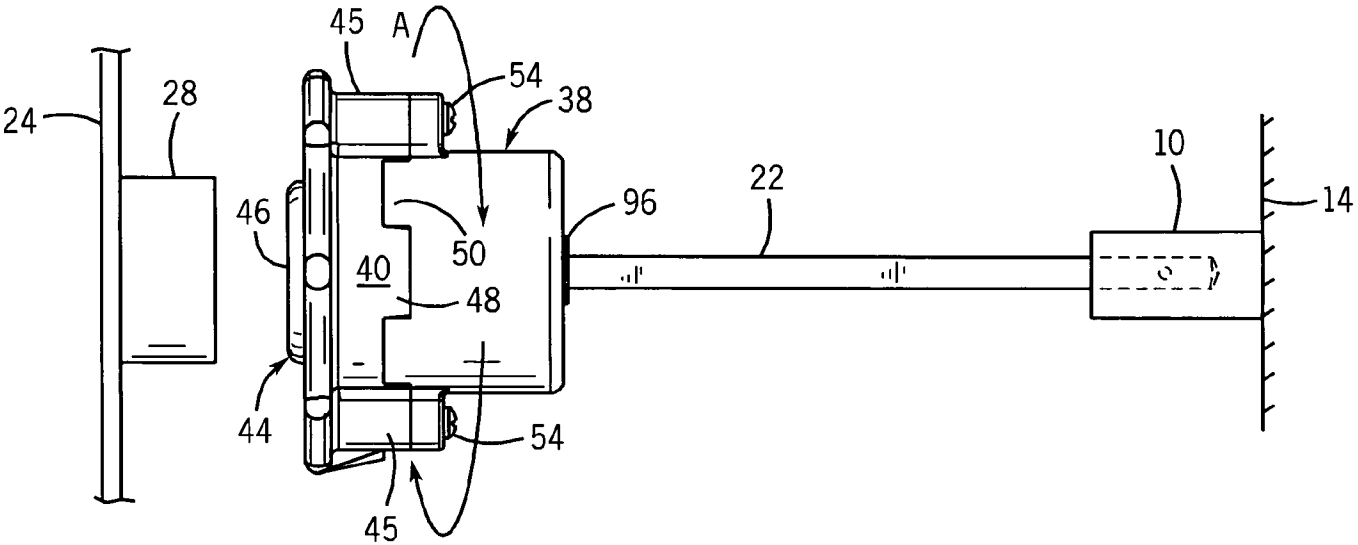
FIG. 6 is a side elevation view of the operator assembly illustrated in FIG. 3 when the door is open.

Operation of operator assembly 36 will now be described with initial reference to FIGS. 6 and 8 illustrating door 24 in an open position and hub 44 in its normal position biased outwards by spring 39. In this position, pawls 52 are axially displaced and disengaged from ribs 60, thus illustrating bi-directional coupling mechanism 67 in a disengaged position. As a result, when a user rotates operator assembly 36 (e.g., via handle 40), the disengaged coupling mechanism 67 does not cause shaft 22 to correspondingly rotate.

Figure 16:
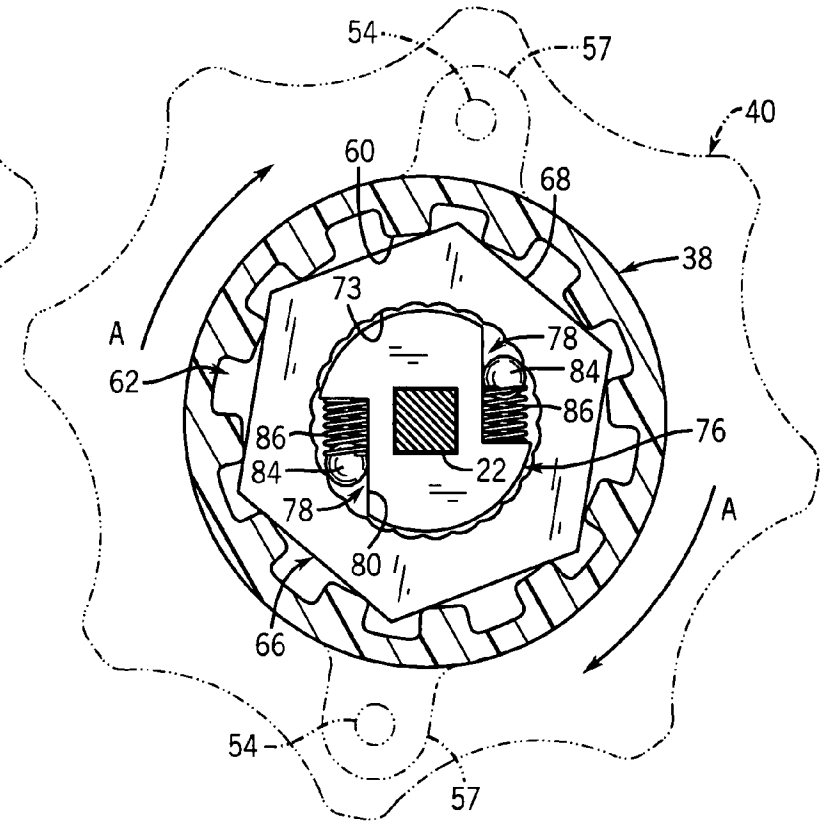
FIG. 16 is a sectional top elevation view of the uni-directional coupling mechanism similar to FIG. 15 as the operator assembly is rotated clockwise.
Figure 15:
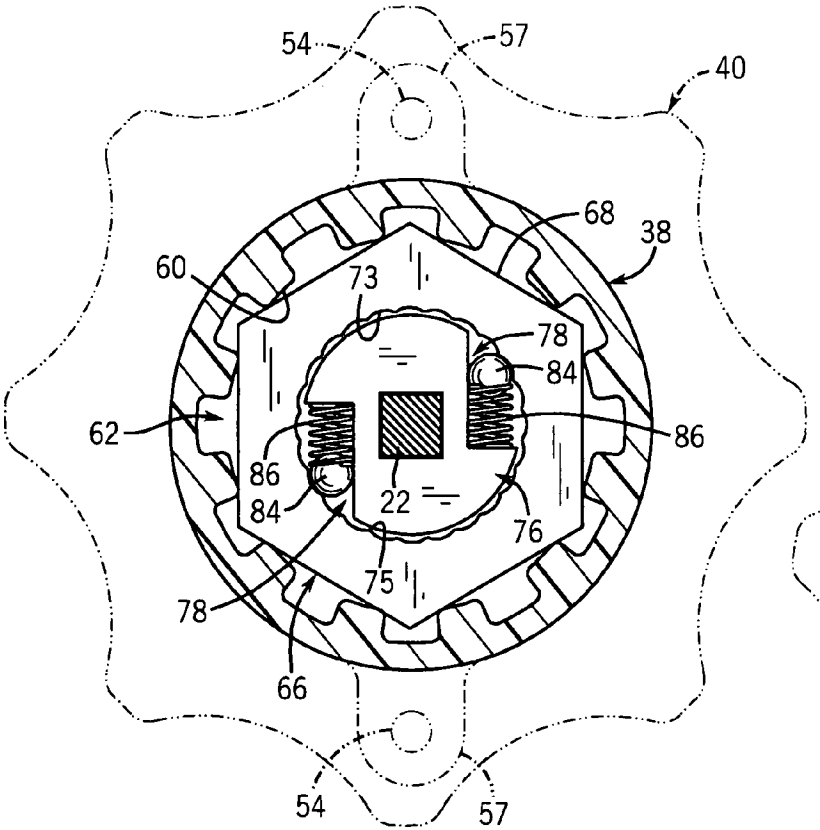
FIG. 15 is a sectional top elevation view of the uni-directional coupling mechanism illustrated in FIG. 14.

Rather, referring to FIGS. 15 and 16, uni-directional coupling mechanism 64 operates as described above. Specifically, when a user applies a torque to operator assembly 36 in the counterclockwise direction, for example via handle 40 (i.e., in an attempt to disconnect power in fuse block 10), inner shell ribs 60 impart a corresponding counterclockwise force onto bearing cup 66 which, in turn, causing bearing members 84 to engage grooved track 73 and rotatably couple bearing cup 66 and carrier plate 76. Accordingly, counterclockwise rotation of operator assembly 36 causes carrier plate 76 (and shaft 22) to correspondingly rotate, thus allowing power to be disconnected in fuse block 10.

On the contrary, when a torque is applied to operator assembly 36 in the clockwise direction (i.e., in an attempt to connect power in fuse block 10), bearing member(s) 84 compress corresponding spring(s) 86 and ratchet along track 73. Accordingly, bearing cup 66 rotates about carrier plate 76 (and shaft 22), thus preventing power from being reconnected in fuse block 10. Furthermore, because operator assembly 36 is allowed to freely rotate in the clockwise direction, uni-directional coupling mechanism 64 provides tactile feedback that power is not permitted to be connected to fuse block 10 by simply rotating operator assembly 36. Moreover, if the user is attempting to disconnect power from fuse block 10, coupling mechanism 64 induces the user to rotate operator assembly 36 in the opposite, and correct, direction.

The present inventors have recognized that certain internal disconnect switches in fuse block 10 are configured to operate under a low amount of torque. The amount of torque necessary to cause bearing members 84 to ratchet along track 73 can be controlled at each individual pocket 78, for example, by adjusting the spring constant of spring 86, the geometric configuration of teeth 75, and the size of bearing members 84. Alternatively, the driving torque force can be controlled by the number of pockets 78 formed in carrier plate 76 as described above. Advantageously, the amount of torque necessary to cause bearing members 84 to ratchet along track 73 is less than the amount of torque necessary to operate the disconnect switch.

Figure 7:
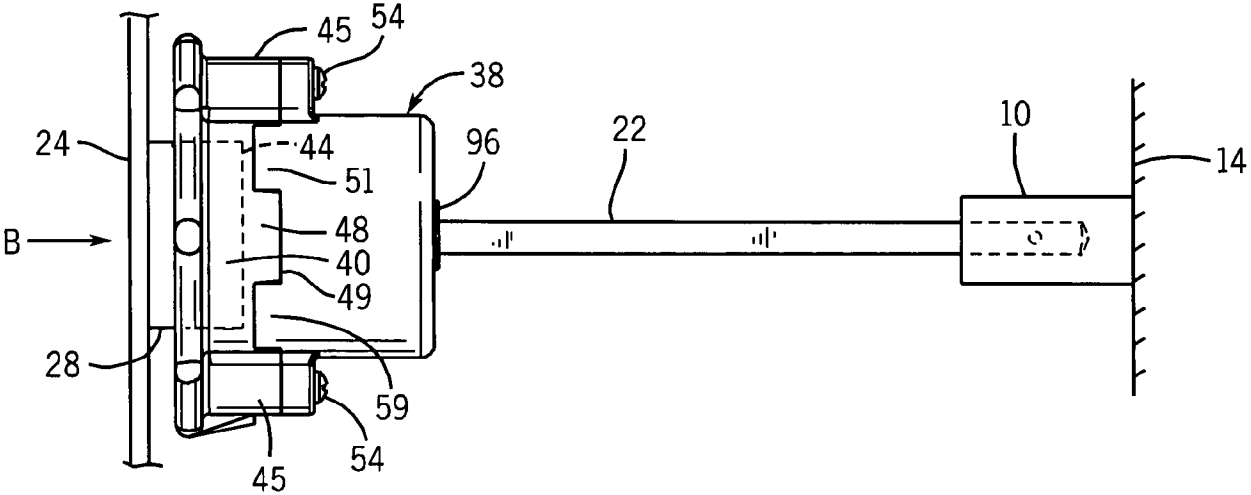
FIG. 7 is a side elevation view of the operator assembly illustrated in FIG. 3 when the door is closed.
Figure 9:
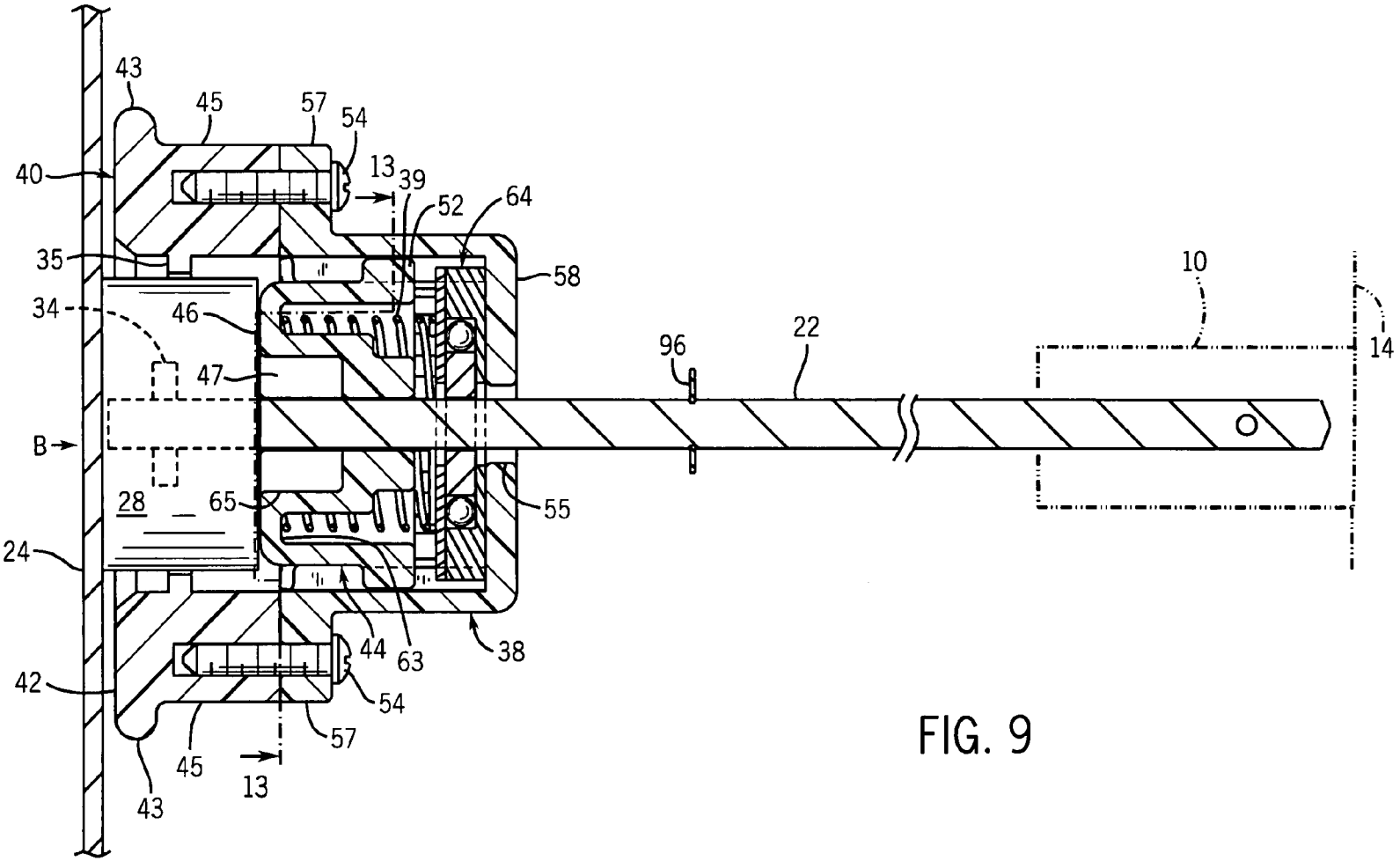
FIG. 9 is a sectional side elevation view of the operator assembly in the position illustrated in FIG. 7.

Referring now to FIGS. 7,9, and 12, bi-directional coupling mechanism 67 can be engaged in one of two ways. First, door 24 can be closed, thus causing connector 28 to depress hub 44 relative to inner shell 38 against the biasing forces of spring 39 as indicated by Arrow B. Secondly, bi-directional coupling mechanism 67 can be engaged by manually depressing hub 44 relative to operator assembly 36 by either depressing hub 44 directly, or by pulling handle 40 out, thus raising inner shell 38 relative to hub 44. Whether door 24 is closed or hub 44 is manually depressed relative to shell 38, pawls 52 become interdigitated with ribs 60 thus rotatably interlocking hub 44 and operator assembly 36. The beveled ends of pawls 52 and ribs 60 assist in engaging coupling mechanism 67. Because shaft 22 is coupled to hub 44, when operator assembly 36 is rotated clockwise and counterclockwise with bi-directional coupling mechanism 67 engaged, shaft 22 rotates along with operator assembly 36 causing power to be connected and disconnected, respectively.

It is thus appreciated that when door 24 is closed and a user wishes to access fuse block 10, the user actuates knob 26, which causes operator assembly 36 to rotate counterclockwise, thereby disconnecting power from fuse block 10. Once door 24 is open (disconnecting bi-directional coupling mechanism 67) and operator assembly 36 is rotated clockwise, uni-directional coupling mechanism 64 will prevent shaft 22 from reconnecting power in fuse block 10. Rather, the user must first perform a predetermined sequence of events by manually depressing hub 44 relative to shell 38 in order to reengage bi-directional coupling mechanism 67. While hub 44 is depressed, operator assembly 36 can be rotated clockwise to reconnect power in fuse block 10.

The invention has been described in connection with what are presently considered to be the most practical and preferred embodiments. However, the present invention has been presented by way of illustration and is not intended to be limited to the disclosed embodiments. For example, while the present invention is applicable to fuse blocks of the type described above, it should be appreciated that the present invention is applicable to any handle-operated device that would benefit from coupling mechanisms 64 and 67. Accordingly, those skilled in the art will realize that the invention is intended to encompass all modifications and alternative arrangements included within the spirit and scope of the invention, as set forth by the appended claims.

We claim:

1. An operator assembly for controlling a disconnect having a rotary shaft adapted to receive a portion of a door-mounted knob and rotating in a first direction to connect electrical current through the disconnect, and rotating in a second direction to prevent electrical current from flowing through the disconnect, the operator assembly further comprising:

a housing configured to receive the rotary shaft, and a uni-directional coupling mechanism that is connected between the shaft and the housing, wherein the uni-directional coupling mechanism facilitates uni-directional rotation of the shaft in response to rotation of the operator assembly.

2. The operator assembly as recited in claim 1, wherein the uni-directional coupling mechanism comprises a ratchet mechanism.

3. The operator assembly as recited in claim 2, wherein the ratchet mechanism includes a bearing cup coupled to the housing that receives a plate coupled to the shaft, wherein the plate is interlocked with the bearing cup with respect to rotation in only the second direction.

4. The operator assembly as recited in claim 3, wherein the plate carries a bearing member biased under a spring force against a track formed in the bearing cup.

5. The operator assembly as recited in claim 4, wherein the bearing member rides along the track when the housing and bearing cup are rotated in the first direction.

6. The operator assembly as recited in claim 5, wherein the bearing member becomes interlocked with the track when the housing and bearing cup are rotated in the second direction.

7. The operator assembly as recited in claim 6, wherein the bearing member is disposed in a rectangular pocket formed in the carrier member.

8. The operator assembly as recited in claim 4, wherein the track is grooved.

9. The operator assembly as recited in claim 4, wherein the track is smooth.

10. The operator assembly as recited in claim 4, wherein a plurality of bearing members engage the track.

11. The operator assembly as recited in claim 1, wherein the uni-directional rotation is in a the second direction.

12. The operator assembly as recited in claim 1, further comprising a bi-directional coupling mechanism that is releasably connected between the shaft and the housing, wherein the bi-directional coupling mechanism rotates the shaft in the first and second directions in response to rotation of the housing in the first and second directions.

13. The operator assembly as recited in claim 12, wherein the bi-directional coupling mechanism includes a hub disposed in the housing that is depressible relative to the housing to interlock the hub with the housing with respect to rotational motion.

14. The operator assembly as recited in claim 13, wherein the hub includes at least one protrusion that interlocks with at least one corresponding protrusion extending from the housing when the hub is depressed.

15. The operator assembly as recited in claim 13, wherein the bi-directional coupling mechanism is disengaged when the hub is released.

16. The operator assembly as recited in claim 15, further comprising a spring member that biases the hub outwardly causing disengagement of the bi-directional coupling mechanism.

17. The operator assembly as recited in claim 14, wherein the door depresses the hub when the door is closed.

18. The operator assembly as recited in claim 17, further comprising a clutch that engages the bi-directional coupling mechanism when the hub is depressed relative to the housing.

19. A method for operating a rotary shaft coupled to a disconnect and accessible by a door that can be opened and closed, the steps comprising:

A) providing an operator carrying a uni-directional coupling mechanism, wherein the operator is carried by the shaft; and B) rotating the operator in a first direction with the operator and shaft disconnected with respect to rotation by the uni-directional coupling mechanism; and C) rotating the operator in a second direction with the operator and shaft connected with respect to rotation by the uni-directional coupling mechanism.

20. The method as recited in claim 19, wherein step (B) further comprises coupling the operator and shaft with respect to rotation in the second direction that prevents electrical current from flowing through the disconnect.

21. The method as recited in claim 19, further comprising ratcheting a bearing cup about a carrier plate that is rotatably coupled to the shaft, wherein the bearing cup is rotatably coupled to the operator.

22. The method as recited in claim 19, wherein step (B) further comprises moving a bearing member over a track formed in the bearing cup.

23. The method as recited in claim 22, wherein step (C) further comprises interlocking the bearing cup and the carrier plate with respect to rotation in the second direction.

24. The method as recited in claim 23, further comprising engaging a bearing member with the track to interlock the bearing cup and carrier plate.

25. The method as recited in claim 24, wherein the track is grooved.

26. The method as recited in claim 25, wherein the track is smooth.

27. The method as recited in claim 19, further comprising the step of:

D) engaging a bi-directional coupling mechanism and rotating the operator in a first and second direction to correspondingly rotate the shaft to connect electrical current through the disconnect and prevent electrical current from flowing through the disconnect, respectively.

28. The method as recited in claim 27, wherein step (B) further comprises disengaging the bi-directional coupling mechanism to engage the uni-directional coupling mechanism.

29. The method as recited in claim 28, further comprising closing the door to engage the bi-directional coupling mechanism.

30. The method as recited in claim 29, wherein step (D) further comprises manually actuating an engagement member to engage the bi-directional coupling mechanism.

31. The method as recited in claim 30, wherein the engagement member is rotatably coupled to the shaft, and wherein step (D) rotatably couples the engagement member to the operator.

32. The method as recited in claim 30, further comprising biasing the engagement member out of connection with the operator via a spring member.

33. An operator assembly for a disconnect having a rotary shaft adapted to receive a portion of a door-mounted knob and rotating in a first direction to connect current through the disconnect, and rotating in a second direction to prevent current from flowing through the disconnect, the operator assembly further comprising:

(a) a housing;

(b) a bi-directional coupling mechanism that is releasably connected between the shaft and the housing, wherein the bi-directional coupling mechanism rotates the shaft in the first and second directions in response to rotation of the operator assembly in the first and second directions when the bi-directional coupling mechanism is connected; and (c) a uni-directional coupling mechanism that is connected between the shaft and the operator assembly, wherein the uni-directional coupling mechanism facilitates uni-directional rotation of the shaft in response to rotation of the operator assembly.

34. The operator assembly as recited in claim 33, wherein the uni-directional rotation is in the second direction.

35. The operator assembly as recited in claim 33, wherein the bi-directional coupling mechanism includes a hub disposed in the housing that is depressible relative to the housing to interlock the hub with the housing with respect to rotational motion.

36. The operator assembly as recited in claim 35, wherein the hub includes at least one protrusion that interlocks with at least one corresponding protrusion extending from the housing when the hub is depressed.

37. The operator assembly as recited in claim 35, wherein the bi-directional coupling mechanism is disengaged when the hub is released.

38. The operator assembly as recited in claim 37, further comprising a spring member that biases the hub outwardly causing disengagement of the bi-directional coupling mechanism.

39. The operator assembly as recited in claim 35, wherein the door depresses the hub when the door is closed.

40. The operator assembly as recited in claim 33, wherein the uni-directional coupling mechanism comprises a ratchet mechanism.

41. The operator assembly as recited in claim 40, wherein the ratchet mechanism includes a bearing cup coupled to the housing that receives a plate coupled to the shaft, wherein the plate is interlocked with the bearing cup with respect to rotation in only the second direction.

42. The operator assembly as recited in claim 41, wherein the plate carries a bearing member biased under a spring force against a track formed in the bearing cup.

43. The operator assembly as recited in claim 42, wherein the bearing member rides along the track when the bi-directional coupling mechanism is disengaged and the housing and bearing cup are rotated in the first direction.

44. The operator assembly as recited in claim 43, wherein the bearing member becomes interlocked with the track when the housing and bearing cup are rotated in the second direction.

45. The operator assembly as recited in claim 44, wherein the bearing member is disposed in a rectangular pocket formed in the carrier member.

46. The operator assembly as recited in claim 42; wherein a plurality of bearing members engage the track.

47. The operator assembly as recited in claim 42, wherein the track is grooved.

48. The operator assembly as recited in claim 42, wherein the track is smooth.

49. A method for operating a rotary shaft coupled to a disconnect and accessible by a door that can be opened and closed, the steps comprising:

A) providing an operator carrying a bi-directional coupling mechanism and a uni-directional coupling mechanism carried by the shaft;

B) engaging the bi-directional coupling mechanism and rotating the operator in a first and second direction to correspondingly rotate the shaft to connect power through the disconnect and disconnect power through the disconnect, respectively;

C) disengaging the bi-directional coupling mechanism; and

D) after step (C), coupling the operator and shaft with respect to uni-directional rotation of the operator via a uni-directional coupling mechanism.

50. The method as recited in claim 49, wherein step (B) further comprises closing the door to engage the bi-directional coupling mechanism.

51. The method as recited in claim 50, wherein step (B) further comprises manually actuating an engagement member to engage the bi-directional coupling mechanism.

52. The method as recited in claim 51, wherein the engagement member is rotatably coupled to the shaft, and wherein step (B) rotatably couples the engagement member to the operator.

53. The method as recited in claim 51, further comprising biasing the engagement member out of connection with the operator via a spring member.

54. The method as recited in claim 49, wherein step (D) further comprises coupling the operator and shaft with respect to rotation in the second direction.

55. The method as recited in claim 49, wherein step (D) further comprises ratcheting a bearing cup about a carrier plate that is rotatably coupled to the shaft, wherein the bearing cup is rotatably coupled to the operator.

56. The method as recited in claim 49, wherein step (D) further comprises moving a bearing member over a track formed in the bearing cup.

57. The method as recited in claim 55, wherein step (D) further comprises interlocking the bearing cup and the carrier plate with respect to rotation in the second direction.

58. The method as recited in claim 57, further comprising engaging a bearing member with a track to interlock the bearing cup and carrier plate.

* * * * *